United States Patent [19]

Wang et al.

[11] 4,128,475

[45] Dec. 5, 1978

[54] PROCESS FOR BENEFICIATION OF MINERAL VALUES

[75] Inventors: Samuel S. Wang, Chesire; Eugene L. Smith, Jr., Milford, both of Conn.

[73] Assignee: American Cyanamid Company, Stamford, Conn.

[21] Appl. No.: 817,411

[22] Filed: Jul. 20, 1977

[51] Int. Cl.[2] ..... B03D 1/02

[52] U.S. Cl. ..... 209/166

[58] Field of Search ..... 209/166, 167; 252/61

[56] References Cited

U.S. PATENT DOCUMENTS

| | | | |
|---|---|---|---|
| 2,222,728 | 11/1940 | Tartaro | 209/166 |
| 2,695,101 | 11/1954 | Booth | 209/166 |
| 3,017,028 | 1/1962 | Schoeld | 209/166 X |
| 3,025,313 | 3/1962 | Anderson | 252/61 X |
| 3,322,762 | 5/1967 | Erikson | 544/196 |
| 3,710,939 | 1/1973 | Kostynek | 209/166 |

FOREIGN PATENT DOCUMENTS

| | | | |
|---|---|---|---|
| 583809 | 9/1959 | Canada | 209/166 |
| E12047 | 8/1956 | Fed. Rep. of Germany | 209/166 |
| 27749 | 11/1914 | United Kingdom | 209/166 |
| 145852 | 6/1920 | United Kingdom | 209/167 |
| 398728 | 11/1974 | U.S.S.R. | 209/166 |

*Primary Examiner*—Robert Halper

*Attorney, Agent, or Firm*—William J. van Loo

[57] ABSTRACT

Improved recovery of mineral values is obtained in froth flotation thereof when the frothing composition employed is a combination of a conventional frothing agent and an amino-aldehyde resin.

8 Claims, No Drawings

PROCESS FOR BENEFICIATION OF MINERAL VALUES

CROSS-REFERENCE TO RELATED APPLICATIONS

This case is related to application Ser. No. 817,410, filed on even date herewith. The instant application relates to a process of use of a frother composition and the related application relates to the frother composition per se.

This invention relates to an improved froth flotation process in which beneficiation of mineral values is obtained by use of a synergistic frothing composition. More particularly, this invention relates to such a process wherein the frothing composition is a mixture of a conventional frothing agent or mixtures thereof and an amino-aldehyde resin.

One flotation is a process for separating finely ground valuable minerals from their associated gauge or for separating valuable components one from the other. The process is based on the affinity of properly prepared surfaces for air bubbles. In froth flotation, a froth is formed by introducing air into a pulp of the finely divided ore and water containing a frothing agent. Froth flotation is the principal means of concentrating copper, lead, zinc, phosphate and potash ores as well as a host of others. Its chief advantage is that it is a relatively efficient operation at a substantially lower cost than many other processes.

Frothing agents are used to provide a stable flotation froth, persistent enough to facilitate the mineral separation, but not so persistent that it cannot be broken to allow subsequent processing. The most commonly used frothing agents are pine oil (an impure terpineol, $C_{10}H_{17}OH$); creosote and cresylic acid; and alcohols such as 4-methyl-2-pentanol, polypropylene glycols and ethers.

In addition to the frothing agent, the aqueous ore slurry being processed will contain a selected collector which has particular selectivity for the mineral values that are desired to be recovered by froth flotation. Thus, the slurry containing ore and frother is conditioned with the proper collector and subjected to froth flotation by introducing air into such slurry. A froth is generated by action of the air introduced and the frother. The desired mineral values coated with the selected collector entrap the air bubbles and are leviated as a result, rising into the froth layer which overflows the flotation device. The operation is continued until further build-up of levitated mineral values in the froth ceases. The mineral value recovered by froth flotation of the native ore is designated as the "rougher concentrate" and the residue is designated as the "rougher tails." Subsequently, the rougher concentrate may be subjected to additional froth flotation in one or more operations to provide what are termed "cleaner concentrates" and "cleaner tails." In some operations where the collector is itself a frothing agent, it is possible to omit the addition of a frother per se, but in most operations a frother is essential, as is a collector.

Much progress has been made in developing improved and more selective collectors for the froth flotation of specific mineral values, including modifiers for existing collectors. Frothers have generally been considered on the basis of the froth generated. The available frothers are either too weak in frothing properties which produces poor recovery or too strong in such properties which produces poor selectivity. Combinations of these frothers generally lead to less recovery and selectivity than is desirable and recourse is had to improved collectors.

If there could be developed a means for improving performance of frothing agents, such a development could lead to improved recovery and selectivity over what is possible solely by collector modification. Such a development could not only lead to better conservation of our depleting mineral resources but also could reduce costs and energy requirements in providing a given level of mineral values. The provision for such a development would fulfill a long-felt need and constitute a notable advance in the art.

In accordance with the present invention, there is provided an improvement in the process of beneficiating mineral ores by froth flotation, the improvement comprising using as the frothing agent a composition comprising about 1 to about 99 weight percent of a conventional frothing agent or mixture thereof and correspondingly, from about 99 to about 1 percent of an amino-aldehyde resin.

The improved performance of the frothing composition of the present invention is highly surprising and totally unexpected. The amino-aldehyde resin is not an effective frothing agent and, therefore, it is totally unexpected that replacement of part of the dosage of a conventional frother agent with a like amount of an amino-aldehyde resin would lead to increased recovery and selectivity of mineral values using a standard collector in conjunction with froth flotation.

The process of the present invention is specifically directed to the use of a combination of two ingredients, a conventional frothing agent and an amino-aldehyde resin. The particular proportions of the ingredients making up the composition appear to vary widely depending upon the particular frothing agent and amino-aldehyde resin employed, and there appears to be an optimum mixing ratio for each combination. However, the combination of frothing agent and amino-aldehyde resin appears to provide advantages over the sole use of frothing agent at the level present in the combination in spite of the ineffectiveness of the amino-aldehyde resin as a frothing agent. Accordingly, the frother combination of the present invention may contain from about 1 to about 99 weight percent of frothing agent and, correspondingly, from about 1 to about 99 weight percent of amino-aldehyde resin. In preferred combinations, the frothing agent will comprise about 50 to 80, more preferably 67 to 75, weight percent of the frother combination and the amino-aldehyde resin, correspondingly, will comprise about 50 to 20, more preferably 33 to 25, weight percent thereof.

Conventional frothing agents include alcohols of about 5 to 8 carbon atoms, pine oils, polypropylene glycols and ethers, ethoxylated alcohols of about 5 to 8 carbon atoms, and the like. Many of the conventional frothing agents are mixed compositions. The mixtures arise both for performance and economical reasons. For example, a particularly effective frothing agent is a mixture of 90 weight percent of methyl isobutyl carbinol and 10 weight percent of still bottoms.

The amino-aldehyde resin, as that term is employed herein, is a low molecular weight reaction product of an aldehyde and an amino-compound reactive therewith as well as alkylated derivatives of such reaction products. Amino-compounds which form reaction products with aldehydes that are useful in the composition of the present invention include, for example, urea, melamine, guanamines, ethylene urea, acetylene diureas, pyrimidines, tetrahydropyrimidones, thiourea, carbamates, urethanes, and the like. As aldehydes to form the reaction products, there may be used such aldehydes as formaldehyde, acetaldehyde, benzaldehyde, glyoxal, and the like. The particular molar ratio of aldehyde to amino-compound used to form the reaction product will vary depending upon the reaction functionality of the amino-compound. Melamine, for example, has a reaction functionality of six and can react with up to six moles of aldehyde.

The amino-aldehyde is preferably an alkylated aldehyde reaction product, alkylation generally increasing stability of the reaction product. Useful alkylating agents include methanol, ethanol, butanol, hexanol and the like. It is generally preferred to alkylate fully the methylol compound provided. Thus, in the case of melamines the hexamethoxymethyl derivative is preferred. Also, in the case of acetylenediurea, the tetralkoxymethyl derivative is preferred.

A collector is one which selectively forms a hydrophobic coating on the mineral surfaces (sulfides, oxides or salts) so that the air bubbles will cling to the solid particles in the presence of frother and concentrate them in the froth. The most common collectors are hydrocarbon compound which contain anionic or cationic polar group. Examples are the fatty acids, the fatty soaps, xanthates, thionocarbamates, dithiocarbamates, fatty sulfates, and fatty sulfonates and the fatty amine derivatives. Other useful collectors are mercaptans, thioureas, dialkyldithiophosphates, and dialkyldithiophosphinates.

In carrying out processing using the frother composition of the present invention, an ore capable of beneficiation by froth flotation is selected. The ore is ground to provide particles of flotation size and slurried in water for processing. An effective amount of the frothing composition of the present invention is added along with a suitable collector and other additives normally employed in processing the ore. The frother employed in the process of the present invention may be a frother conventionally employed, except that of course, an amino-aldehyde resin is used therewith.

After the ore has been properly conditioned with the various additives selected, it is subjected to froth flotation following conventional procedures. In most instances, the desired ore values will be floated off as a froth, leaving behind tailings of the guague materials. In some instances, the material floated off may be gaugue materials with the desired mineral values remaining behind. In still other instances, the floated material may represent desired mineral values of one type and the material remaining behind may represent desired mineral values of another type. The mineral values being processed may be those obtained from a previous froth flotation procedure, processing being purification thereof to provide a cleaner concentrate.

The invention is more fully illustrated in the examples which follow wherein all parts and percentages are by weight unless otherwise specified.

EXAMPLES 1–4

A series of runs were made using a copper ore. The ore slurry was processed at pH 10.8–11.0 using a mixture of 2 parts of potassium amyl xanthate and 1 part of sodium di-secondary butyl thiophosphate as collector at a dosage of 0.1 pound per ton of ore. Various frother were evaluated, with identity and dosage levels given in Table I which also indicates the recovery obtained.

Table 1

Copper Recovery Using Various Frothers

| Example | Frother | Dosage lb./ton | Weight (%) Recovery | % Cu Feed | % Cu Tails | % Cu Conc. | Copper Recovery (%) |
|---|---|---|---|---|---|---|---|
| Comparative A | HMMM[1] | 0.025 | — | Failed to Froth | | | |
| Comparative B | HMMM | 0.062 | 3.66 | 0.280 | 0.094 | 5.16 | 67.58 |
| 1 | 1 part HMMM + 1 part M1BC[2] | 0.025 | 3.56 | 0.284 | 0.075 | 5.96 | 74.59 |
| 2 | 1 part HMMM + 2 parts M1BC | 0.025 | 4.87 | 0.281 | 0.050 | 4.79 | 83.06 |
| 3 | 1 part HMMM + 3 parts M1BC | 0.025 | 5.40 | 0.278 | 0.018 | 4.84 | 93.88 |
| 4 | 1 part HMMM + 4 parts M1BC | 0.025 | 3.89 | 0.284 | 0.050 | 6.06 | 83.08 |
| Comparative C | M1BC | 0.025 | 5.29 | 0.282 | 0.069 | 4.09 | 76.82 |
| Comparative D | M1BC | 0.0125 | 7.77 | 0.269 | 0.088 | 2.42 | 69.84 |

Notes:
[1]HMMM = Hexakis(methoxymethyl)melamine
[2]M1BC = 90% Methyl isobutyl carbinol and 10% still bottoms.

The results show that a combination of 3 parts of hexakis(methoxymethyl)melamine and 1 part of methylisobutyl carbinol composition provides optimum results in copper recovery. The preferred combinations are more effective than the individual components, thus providing a synergistic effect.

EXAMPLES 5–8

The procedure of Examples 1–4 was repeated except that a different frother was used. The frother employed was Pine Oil (P.O.). Details and results are given in Table II.

TABLE II

Copper Recovery Using Pine Oil Frothers

| Example | Frother | Dosage lb./ton | Weight (%) Recovery | % Cu Feed | % Cu Tail | % Cu Conc. | Copper Recovery (%) |
|---|---|---|---|---|---|---|---|
| Comparative E | Pine Oil | 0.0125 | 4.13 | 0.294 | 0.088 | 5.09 | 71.34 |
| Comparative F | Pine Oil | 0.025 | 4.09 | 0.285 | 0.069 | 5.35 | 76.77 |
| 5 | 1 part P.O. + 1 part HMMM | 0.025 | 3.12 | 0.290 | 0.075 | 6.97 | 74.95 |
| 6 | 2 parts P.O. + 1 part HMMM | 0.025 | 3.34 | 0.288 | 0.075 | 6.45 | 74.85 |
| 7 | 3 parts P.O. + 1 part HMMM | 0.025 | 4.04 | 0.257 | 0.056 | 5.04 | 79.11 |
| 8 | 4 parts P.O. + 1 part HMMM | 0.025 | 4.01 | 0.289 | 0.056 | 5.86 | 81.39 |

The results again show synergistic effects of combinations of the present invention.

EXAMPLES 9–12

The procedure of Examples 1–4 was again followed except that a different frother was used. The frother was a polypropylene glycol (PPG) of 425 molecular weight. Details and results are given in Table III.

Table 3

Copper Recovery Using Polypropylene Glycol Frothers

| Example | Frother | Dosage lb./ton | Weight (%) Recovery | % Cu Feed | % Cu Tail | % Cu Conc. | Copper Recovery (%) |
|---|---|---|---|---|---|---|---|
| Comparative G | PPG | 0.025 | 3.84 | 0.284 | 0.069 | 5.66 | 76.62 |
| 9 | 1 part PPG + 1 part HMMM | 0.025 | 3.31 | 0.281 | 0.075 | 6.31 | 74.23 |
| 10 | 2 parts PPG + 1 part HMMM | 0.025 | 3.29 | 0.281 | 0.050 | 7.07 | 82.78 |
| 11 | 3 parts PPG + 1 part HMMM | 0.025 | 3.65 | 0.277 | 0.050 | 6.26 | 82.59 |
| 12 | 4 parts PPG + 1 part HMMM | 0.025 | 4.36 | 0.292 | 0.075 | 5.05 | 75.42 |

The results again show synergism using combinations of the present invention.

We claim:

1. In a process of beneficiation of mineral ore by froth flotation in the presence of a collector, the improvement which comprises using as the frothing agent a composition comprising from about 1 to about 99 weight percent of a frothing agent selected from the group consisting of pine oil, creosote, cresylic acid, alcohols, polypropylene glycols and ethers and, correspondingly, from about 99 to about 1 weight percent of an amino-aldehyde resin comprising the alkylated reaction product of an aldehyde and a material selected form the group consisting of urea, melamine, guanamines, ethylene urea, aceylen diureas, pyrimidines, tetrahydropyrimidines, thiourea, carbamates and urethanes.

2. The process of claim 1 wherein said composition contains from about 20 to 50 weight percent of amino-aldehyde resin.

3. The process of claim 1 wherein said composition contains methyl isobutyl carbinol as the frothing agent.

4. The process of claim 1 wherein said composition contains pine oil as the frothing agent.

5. The process of claim 1 wherein said composition contains polypropylene glycol of molecular weight 425 as the frothing agent.

6. The process of claim 3 wherein said amino-aldehyde resin is hexakis(methoxymethyl)melamine.

7. The process of claim 4 wherein said amino-aldehyde resin is hexakis(methoxymethyl)melamine.

8. The process of claim 5 wherein said amino-aldehyde resin is hexakis(methoxymethyl)melamine.

* * * * *